US008048239B2

(12) United States Patent
Hamada et al.

(10) Patent No.: US 8,048,239 B2
(45) Date of Patent: Nov. 1, 2011

(54) FERRITIC STAINLESS STEEL SHEET SUPERIOR IN SHAPEABILITY AND METHOD OF PRODUCTION OF THE SAME

(75) Inventors: Junichi Hamada, Tokyo (JP); Naoto Ono, Tokyo (JP); Yoshiharu Inoue, Futtsu (JP); Ken Kimura, Futtsu (JP)

(73) Assignee: Nippon Steel & Sumikin Stainless Steel Corporation, Tokyo (JP)

( * ) Notice: Subject to any disclaimer, the term of this patent is extended or adjusted under 35 U.S.C. 154(b) by 0 days.

(21) Appl. No.: 12/229,825

(22) Filed: Aug. 26, 2008

(65) Prior Publication Data

US 2009/0000703 A1 Jan. 1, 2009

Related U.S. Application Data

(62) Division of application No. 10/562,995, filed as application No. PCT/JP2005/006563 on Mar. 29, 2005, now abandoned.

(30) Foreign Application Priority Data

Apr. 7, 2004 (JP) ..... 2004-113478

(51) Int. Cl.
*C21D 8/02* (2006.01)
*C22C 38/22* (2006.01)
*C22C 38/26* (2006.01)

(52) U.S. Cl. ..... 148/516; 148/325

(58) Field of Classification Search ..... 148/516, 148/325

See application file for complete search history.

(56) References Cited

U.S. PATENT DOCUMENTS

| | | | | |
|---|---|---|---|---|
| 4,374,683 | A * | 2/1983 | Koike et al. | 148/610 |
| 6,673,166 | B2 * | 1/2004 | Oku et al. | 148/326 |
| 7,094,295 | B2 * | 8/2006 | Oku et al. | 148/592 |
| 7,267,730 | B2 | 9/2007 | Inoue et al. | |

FOREIGN PATENT DOCUMENTS

| | | |
|---|---|---|
| EP | 1 207 214 A | 5/2002 |
| EP | 1 219 719 A1 | 7/2002 |
| EP | 1 571 227 A1 | 9/2005 |
| JP | 8-199235 | 8/1996 |
| JP | 9-118961 | 5/1997 |
| JP | 9-125209 | 5/1997 |
| JP | 9-279312 | 10/1997 |
| JP | 10 237596 A | 9/1998 |
| JP | 2002-30346 | 1/2002 |
| JP | 2002-194507 | 7/2002 |
| JP | 2003-155543 | 5/2003 |

* cited by examiner

*Primary Examiner* — Jie Yang
(74) *Attorney, Agent, or Firm* — Kenyon & Kenyon, LLP

(57) ABSTRACT

The present invention provides a ferritic stainless steel sheet superior in shapeability containing, by wt %, C: 0.001 to 0.010%, Si: 0.01 to 1.0%, Mn: 0.01 to 1.0%, P: 0.01 to 0.04%, Cr: 10 to 20%, N: 0.001 to 0.020%, Nb: 0.3 to 1.0%, and Mo: 0.5 to 2.0%, wherein the total precipitates are, by wt %, 0.05 to 0.60%. A method of production of a ferritic stainless steel sheet superior in shapeability comprising producing a cold rolling material in the production process so that the Nb-based precipitates become, by vol %, 0.15% to 0.6% and have a diameter of 0.1 μm to 1 μm and/or so that the recrystallized grain size becomes 1 μm to 40 μm and the recrystallization rate becomes 10 to 90%, then cold rolling and annealing it at 1010 to 1080° C.

3 Claims, 4 Drawing Sheets

FERRITIC STAINLESS STEEL SHEET SUPERIOR IN SHAPEABILITY AND METHOD OF PRODUCTION OF THE SAME

This application is a divisional patent application under 35 U.S.C. §120 and §121 of prior Application No. 10/562,995 filed Dec. 27, 2005 now abandoned which is a 35 U.S.C. §371 of International Application No. PCT/JP2005/006563 filed Mar. 29, 2005, wherein PCT/JP2005/006563 was filed and published in the Japanese language.

TECHNICAL FIELD

The present invention relates to ferritic stainless steel sheet superior in shapeability optimal for use for a part of an exhaust system of an automobile particularly requiring high temperature strength and oxidation resistance and a method of production of the same.

BACKGROUND ART

Automobile exhaust manifolds, mufflers, and other exhaust system parts are required to have high temperature strength and oxidation resistance. Therefore, ferritic stainless steel superior in heat resistance is being used. These parts are produced by press working steel sheet, so press formability of the steel sheet material is sought. On the other hand, the temperatures of the usage environments have been rising each year. It has become necessary to increase the amounts of Cr, Mo, Nb, and other alloying elements added so as to increase the high temperature strength, oxidation resistance, heat fatigue characteristics, etc. If the elements added increase, the workability of the steel sheet material ends up falling with simple production methods, therefore sometimes press forming was not possible.

Indicators of workability include indicators of the ductility, deep drawability, etc. In working the above exhaust parts, the basic indicators of the elongation and r value become important. For improvement of the r value, increasing the cold rolling reduction rate is effective, but since the above parts use relatively thick materials (1.5 to 2 mm or so) as materials, the cold rolling reduction rate cannot be sufficiently secured in current production processes where the thickness of the cold rolling material is limited to a certain extent.

To solve this problem, means have been taken with regard to the ingredients or method of production for improving the r value without damaging the high temperature characteristics.

In the past, to improve the shapeability of the ferritic stainless steel sheet used as the above heat resistant steel, adjustment of the composition has been disclosed as shown in Japanese Patent Publication No. 9-279312, but with this alone, there was the problem of press cracking in thick materials with relatively low cold rolling reduction rates.

Japanese Patent Publication No. 2002-30346 prescribes the optimal hot rolled sheet annealing temperature from the relationship between the hot rolling finishing start temperature and end temperature and Nb content and the hot rolled sheet annealing temperature, but due to the effect of other elements (C, N, Cr, Mo, etc.) involved in Nb-based precipitates, sufficient workability sometimes cannot be obtained by this alone. Further, Japanese Patent Publication No. 8-199235 discloses a method of aging a hot rolled sheet in the range of 650 to 900° C. for 1 to 30 hours. The technical idea is to cause the Nb-based precipitates to precipitate before cold rolling so as to promote recrystallization, but with this method as well, sometimes sufficient workability cannot be obtained and the productivity remarkably falls. In general, hot rolled steel sheet is coiled for supply to the next process, but when aged in the coil state, it is learned that the variation of the structure and the workability when made into the final product become remarkable in the longitudinal direction of the coil (outermost coiled part and innermost coiled part).

DISCLOSURE OF THE INVENTION

The present invention solves the problems in the existing art and provides a ferritic stainless steel sheet superior in shapeability.

To solve the above problem, the inventors engaged in detailed research on the composition and the structure and precipitates of ferritic stainless steel sheet in the production process in relation to the shapeability and thereby completed the invention described below.

The gist of the present invention for solving the problem is as follows.

(1) A ferritic stainless steel sheet superior in shapeability containing, by wt %, C: 0.001 to 0.010%, Si: 0.01 to 0.3%, Mn: 0.01 to 0.3%, P: 0.01 to 0.04%, N: 0.001 to 0.020%, Cr: 10 to 20%, Nb: 0.3 to 1.0%, and Mo: 0.5 to 2.0% and having a balance of Fe and unavoidable impurities, the ferritic stainless steel characterized in that the total precipitates are, by wt %, 0.05 to 0.60%.

(2) A ferritic stainless steel sheet superior in shapeability as set forth in (1), characterized by further containing, by wt %, one or more of Ti: 0.05 to 0.20%, Al: 0.005 to 0.100%, and B: 0.0003 to 0.0050%.

(3) A ferritic stainless steel sheet superior in shapeability as set forth in (1) or (2), characterized by further containing, by wt %, one or more of Cu: 0.2 to 3.0%, W: 0.01 to 1.0%, and Sn: 0.01 to 1.0%.

(4) A method of production of a ferritic stainless steel sheet superior in shapeability characterized by producing a cold rolling material having a composition as set forth in any one of (1) to (3) so that the Nb-based precipitates become, by vol %, 0.15% to 0.6% and have a diameter of 0.1 μm to 1 μm, then cold rolling and annealing it at 1010 to 1080° C.

(5) A method of production of a ferritic stainless steel sheet superior in shapeability characterized by producing a cooled rolling material having a composition as set forth in any one of (1) to (3) so that the recrystallized grain size becomes 1 μm to 40 μm and the recrystallization rate becomes 10 to 90%, then cold rolling and annealing it at 1010 to 1080° C.

(6) A method of production of a ferritic stainless steel sheet superior in shapeability characterized by producing a cold rolling material having a composition as set forth in any one of (1) to (3) so that the Nb-based precipitates become, by vol %, 0.15% to 0.6% and have a diameter of 0.1 tm to 1 pm and so that the recrystallized grain size becomes 1 μm to 40 μm and the recrystallization rate becomes 10 to 90%, then cold rolling and annealing it at 1010 to 1080° C.

BEST MODE FOR WORKING THE INVENTION

Figure 1:
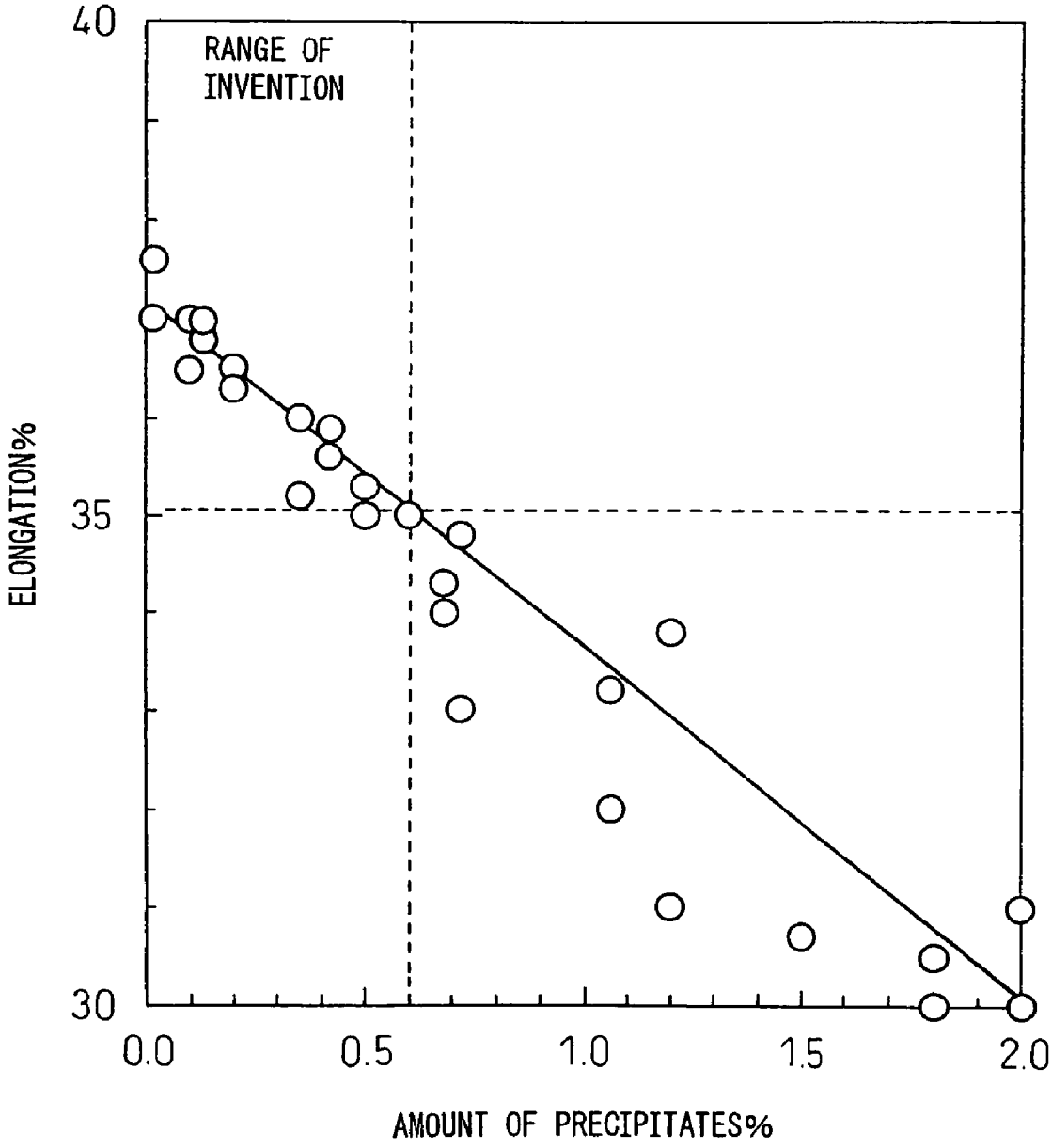
FIG. 1 is a view of the relationship between the amount of precipitation of a sheet product and the elongation.

Below, the reasons for limitation of the present invention will be explained.

Cr has to be added in an amount of 10% or more from the viewpoint of corrosion resistance, but addition over 20% causes deterioration of the ductility and poorer production ability and also deterioration of the quality. Therefore, the range of the Cr was made 10 to 20%. Further, from the viewpoint of securing oxidation resistance and high temperature strength, 13 to 19% is preferable.

Nb is an element necessary for improving the high temperature strength from the viewpoints of solid solution hardening and precipitation strengthening. Further, it functions to fix C and N as carbonitrides and contributes to the recrystallized aggregate structure having an effect on the corrosion resistance and r value of the sheet product. This action appears at 0.3% or more, so the lower limit was made 0.3%. Further, in the present invention, the Nb-based precipitates before cold rolling (Laves phase of Nb carbonitrides or intermetallic compounds mainly comprised of Fe, Cr, Nb, and Mo) are controlled to improve the workability. For this reason, an amount of addition of Nb greater than that for fixing the C and N is necessary. This effect is saturated at 1.0%, so the upper limit was made 1.0%. Further, considering the manufacturing cost and production ability, 0.35 to 0.55% is preferable.

Mo is an element necessary for improving the corrosion resistance and for suppressing high temperature oxidation in heat resistant steel. Further, it is also a Laves phase forming element. To control this and improve the workability, 0.5% or more is necessary. This is because if less than 0.5%, the Laves phase necessary for promoting the recrystallized aggregate structure is not precipitated and the recrystallized aggregate structure of the sheet product does not develop. Further, if considering securing the high temperature strength by solid solution of Mo, the lower limit of Mo is made 0.5%. However, excessive addition causes deterioration of the toughness and a reduction in the elongation, so the upper limit was made 2.0%. Further, considering the manufacturing cost and production ability, 1.0 to 1.8% is preferable.

C causes the shapeability and corrosion resistance to deteriorate, so the content should be as low as possible, so the upper limit was made 0.010%. However, excessive reduction leads to an increase in the refining cost, so the lower limit was made 0.001%. Further, considering the manufacturing cost and corrosion resistance, 0.002 to 0.005% is preferable.

Si is sometimes added as a deoxidizing element and also causes a rise in the oxidation resistance, but is a solid solution hardening element, so quality wise, the smaller the content, the better. Further, the addition of Si acts to promote the Laves phase. If excessively added, the amount of formation of the Laves phase becomes greater, so finely precipitates and causes a drop in the r value, so suitable addition is effective. In the present invention, considering the amount of precipitation and size of the Laves phase in the production process, the upper limit was made 0.3%. On the other hand, to secure the oxidation resistance, the lower limit was made 0.01%. However, However, excessive reduction leads to an increase in the refining cost, so the lower limit was made 0.05%. Further, if considering the quality, the upper limit is preferably 0.25%.

Mn, like Si, is a solid solution hardening element, so in terms of quality, the smaller the content, the better, so the upper limit was made 0.3%. On the other hand, to secure adhesion of the scale, the lower limit was made 0.01%. However, excessive reduction leads to an increase in the refining cost, so the lower limit is preferably 0.10%. Further, considering quality, the upper limit is preferably 0.25%.

P, like Mn and Si, is a solid solution hardening element, so in terms of quality, the smaller the content, the better, so the upper limit is preferably 0.04%. However, excessive reduction leads to an increase in the refining cost, so the lower limit is preferably 0.01%. Further, considering the manufacturing cost and corrosion resistance, 0.015 to 0.025% is more preferable.

N, like C, causes the shapeability and corrosion resistance to deteriorate, so the smaller the content the better, so the upper limit was made 0.020%. However, excessive reduction leads to an increase in the refining cost, so the lower limit was made 0.001%. Further, considering the manufacturing cost, workability, and corrosion resistance, 0.004 to 0.010% is preferable.

Ti is an element which bonds with C, N, and S and is added in accordance with need to improve the corrosion resistance , grain interface corrosion resistance, and deep drawability. The C and N fixing action appears from 0.05%, so the lower limit was made 0.05%. Further, by addition together with Nb, it improves the high temperature strength during long term exposure to high temperatures and contributes to improvement of the oxidation resistance and heat fatigue resistance as well. However, excessive addition causes a drop in the production ability in the steelmaking process or flaws in the cold rolling process, while the increase in solid solution Ti causes the quality to deteriorate, so the upper limit was made 0.20%. Further, considering the manufacturing cost etc., 0.07 to 0.15% is preferable.

Al is sometimes added as a deoxidizing element. Its action appears from 0.005%, so the lower limit was made 0.005%. Further, addition over 0.100% causes a drop in elongation, deterioration of the weldability and surface quality, deterioration of the oxidation resistance, etc., so the upper limit was made 0.10%. Further, considering the refining cost, 0.01 to 0.08% is preferable.

B is an element improving the secondary workability of the product by segregation at the grain boundary. This action appears from 0.0003%, so the lower limit was made 0.0003%. However, excessive addition causes a drop in the workability and corrosion resistance, so the upper limit was made 0.0050%. Further, considering the cost, 0.0005 to 0.0010% is preferable.

Cu, W, and Sn may be added in accordance with the application so as to further stabilize the high temperature strength. If Cu is added in an amount of 0.2% or more and W and Sn are added in amounts of 0.01% or more, they contribute to the high temperature strength. On the other hand, if Cu is added in an amount of over 3.0% and W and Sn are added in amounts of over 1.0%, the ductility remarkably deteriorates and surface flaws develop. Further, considering the manufacturing costs and the production ability, 0.5 to 2.0% is preferable for Cu and 0.1 to 0.5% for W and Sn.

Steel used for heat resistant applications like in the present invention contains relatively large amounts of alloying elements, so the total precipitates become greater than those of general steel. In the present invention, the inventors discovered that the content of the total precipitates of the sheet product has a great effect on the press formability and that making the content by wt % 0.60% or less is effective. FIG. 1 shows the relationship between the amount of precipitation of the sheet product and the elongation. Here, the amount of precipitation is the amount found when using 10% acetyl acetone+1% tetramethyl ammonium chloride+methanol to electrolyze the steel, extracting the total precipitates, and finding the wt % of the total precipitates. The elongation is the elongation at break when conducting a tension test in the rolling direction in accordance with JISZ2241. Due to this, when the amount of precipitation is 0.5% or less, an elongation of 35% or more is obtained. The ductility required in press working of heat resistant steel sheet is thereby obtained. The total amount of precipitates of the sheet product is influenced by the composition and the heat treatment temperature in the production process. In the range of steel composition of the present invention, the annealing temperature of the cold rolled sheet should be at least 1010° C., but excessive high temperature annealing is accompanied with enlargement of the crystal grain size and orange peel and breakage from the orange peel parts at the time of press working, so 1080° C. or less is preferable. The lower the lower limit of the amount of precipitation, the better the elongation, but if too low, deterioration of the high temperature characteristics is caused, so the lower limit was made 0.05%. Preferably, the content is 0.10 to 0.50%.

Next, the structure of the cold rolling material in the production process will be explained.

Figure 3:
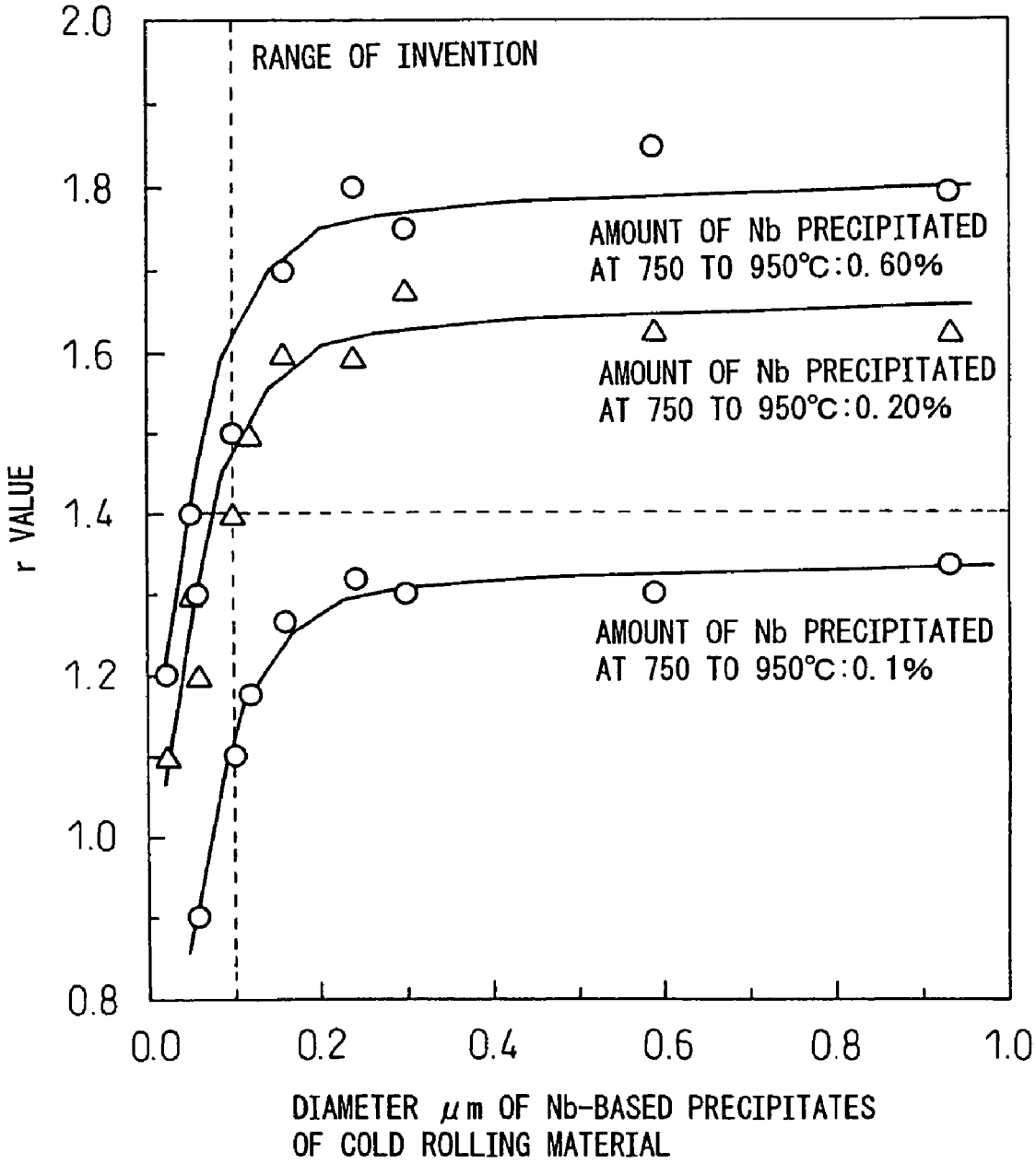
FIG. 3 is a view of the relationship between the diameter of the Nb-based precipitates of the cold rolling material and the r value of the sheet product.

Steel for the main application of the product of the present invention, that is, a heat resistant part, is required to be superior in high temperature characteristics, so Cr, Nb, and Mo are added. The ranges of these elements are as described above, but in steel in which these are added, Nb-based precipitates (mainly Nb carbonitrides and intermetallic compounds containing Nb, Mo, and Cr and called Laves phases) precipitate in the production process and during use. These precipitates precipitate at 950° C. or less. In the present invention, the effect of the amount of precipitation on the workability of the sheet product was carefully investigated. FIG. 3 shows the relationship between the amount of precipitation (wt %) of the Nb-based precipitates when heating the cold rolling material to 700 to 950° C. and the r value of the sheet product. Here, the amount of precipitation is the amount of Nb precipitated found by extraction and analysis of the residue. Further, the average r value was evaluated by obtaining a JIS 13 No. B tension test piece from the cold rolled and annealed sheet, imparting 15% strain in the rolling direction, the direction 45° to the rolling direction, and the direction 90° to the rolling direction, then using equation (1) and equation (2) to find the average r value.

$$r=ln(W_0/W)/ln(t_0/t) \quad (1)$$

Here, $W_0$ is the sheet width before tension, W is the sheet width after tension, to is the sheet thickness before tension, and t is the sheet thickness after tension.

$$\text{Average } r \text{ value}=(r_0+2r_{45}+r_{90})/4 \quad (2)$$

Figure 2:
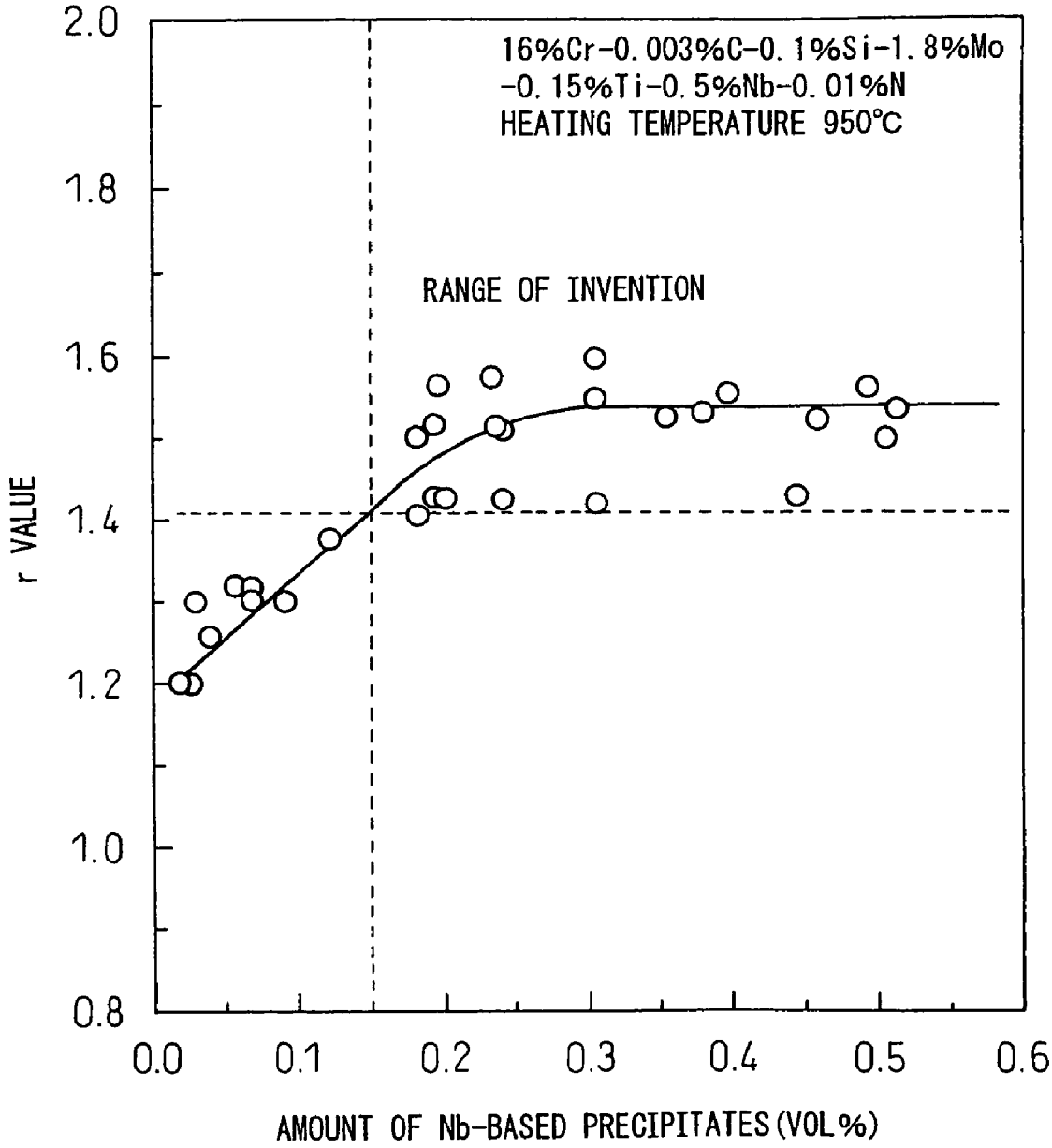
FIG. 2 is a view of the relationship between the amount of Nb-based precipitates precipitated when heating to 700 to 950° C. and the r value of the sheet product.

Here, $r_0$ is the r value of the rolling direction, $r_{45}$ is the r value in the direction 45° from the rolling direction, and $r_{90}$ is the r value in the direction perpendicular to the rolling direction. From FIG. 2, when Nb-based precipitates precipitate in an amount of 0.15% or more, the r value becomes 1.4 or more. The r value expected from heat resistant steel sheet like this steel should be 1.4 or more, so the above was made the range of the present invention. Further, even if the Nb precipitates exceed 0.6%, the effect of the r value become saturated and the toughness of the material is damaged, so the upper limit was made 0.6%. The preferable range is therefore 0.2 to 0.6%.

In the present invention, it was discovered that not only the amount of Nb-based precipitates, but also the size of the precipitates is important for the r value. That is, even if the amount of Nb precipitates becomes greater, if these precipitate finely, they obstruct the recrystallization and grain growth of the matrix in the recrystallization and grain growth process at the time of cold rolling and annealing, so the r value is not improved. FIG. 3 shows the relationship between the diameter of the precipitates present at the cold rolling material and the r value of the sheet product. Here, the "diameter of precipitates" is the value obtained by observing precipitates of the sheet product by an electron microscope, measuring their shapes, then converting them to circle equivalent diameters. The circle equivalent diameters of 100 precipitates are found and their average value used as the diameter of the precipitates. From this, when the diameter of the precipitates present at the cold rolling material is 0.1 μm or more, the r value becomes 1.4 or more. However, if over 1 μm , the effect is saturated and the toughness of the material is detracted from, so the preferable range becomes 0.1 μm to 1 μm. The more preferable range is 0.2 μm to 0.6 μm.

Figure 4:
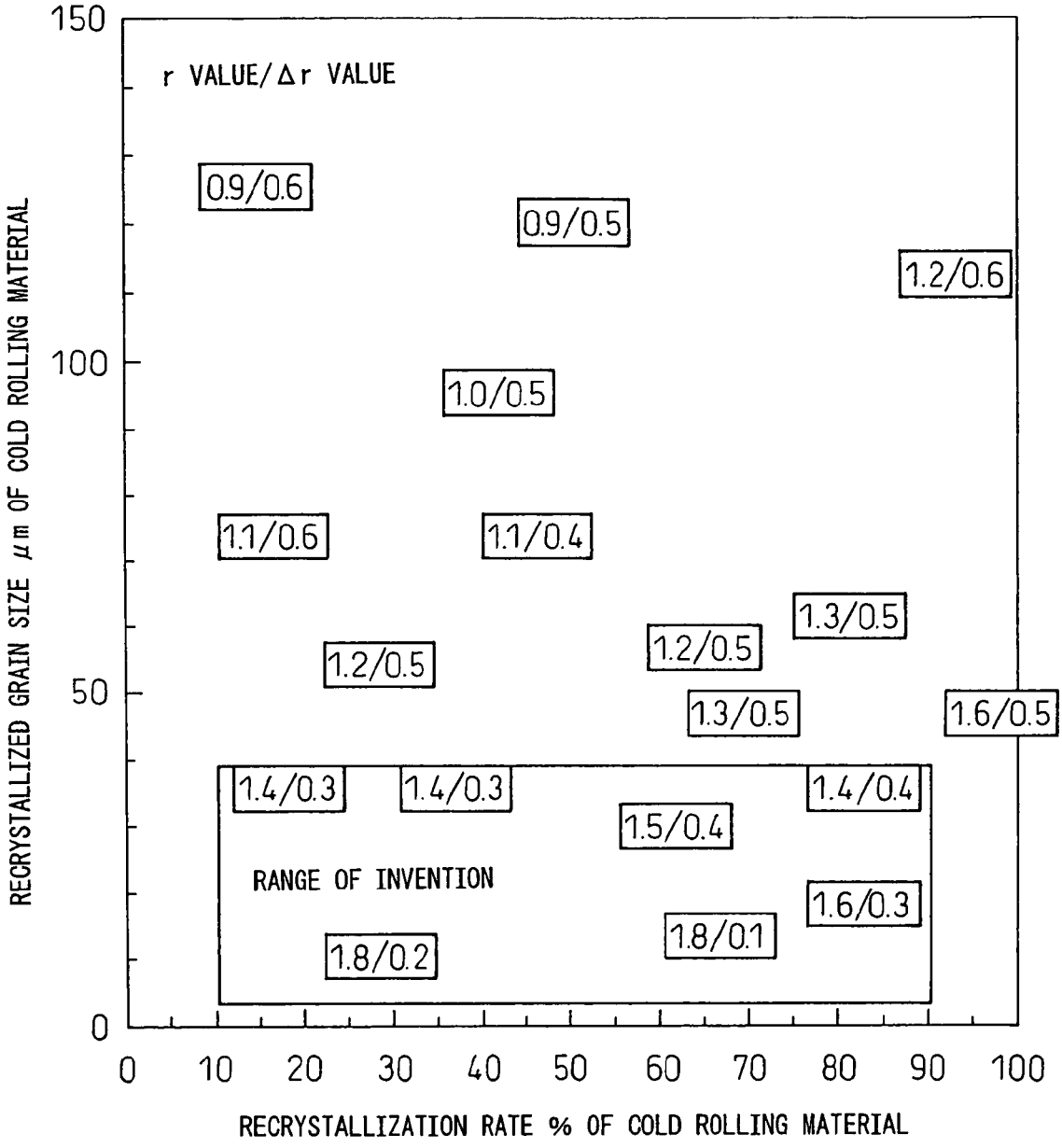
FIG. 4 is a view of the relationship among the recrystallized grain size and the recrystallization rate of the cold rolling material, the r value, and the Δr value.

In the above way, the cold rolling material used is a completely recrystallized material. Therefore, the hot rolling and annealing conditions are determined. However, even if obtaining a completely recrystallized structure, it was learned that if the recrystallized grain size is large, the expected r value sometimes is difficult to obtain. Further, in working a heat resistant part where this steel is used, sometimes not only the r value, but also the small anisotropy of the r value is sought. The anisotropy of the r value is defined by Δr. If this value is large, the shape of the worked part becomes poor and a drop in the yield etc. is caused, so with such a part, a Δr of 0.4 or less is sought. That is, for such working, a high r value and low Δr are sought. In the present invention, it was discovered that a structure of the cold rolling material different from the past is extremely effective. FIG. 4 shows the relationship between the recrystallized grain size and recrystallization rate of the cold rolling material and the r value and Δr value of the sheet product. Due to this, if the preferable range of the recrystallized grain size is 1 μm to 40 μm, the r value becomes 1.4 or more. Further, if the recrystallization rate is 90% or less, the Δr value becomes 0.4 or less. Further, the Δr value is found using equation (3).

$$\Delta r \text{ value}=(r_0+r_{90})/4-2r_{45} \quad (3)$$

It is believed that if making the structure before cold rolling finer in grain, deformation bands are easily introduced from the grain boundaries during cold rolling and, at the time of annealing the cold rolled sheet, a recrystallized aggregate structure improving the r value is easily formed. Further, if the recrystallization rate of the structure before cold rolling is 90% or less, the orientation of the unrecrystallized structure due to the hot rolled structure acts predominantly to reduce anisotropy. If the recrystallization rate is excessively low, a drop in the elongation of the product is caused, so the preferable recrystallization rate is 10 to 90%.

EXAMPLES

Steels of the compositions shown in Table 1 and Table 3 were melted and cast into slabs. The slabs were then hot rolled to obtain hot rolled coils of 5 mm thickness. After this, part of the hot rolled coils were annealed and pickled at the hot rolled sheets, while part of the hot rolled coils were only pickled. These were then cold rolled to 2 mm thickness and continuously annealed and pickled to obtain sheet products. The annealing temperature of the cold rolled sheets was 1010 to 1080° C. at which they were held for 30 to 120 seconds, then air cooled. Test pieces were obtained from the thus obtained sheet products, then the above-mentioned methods were used to measure the r value and the Δr value. Further, a tension test (JIS 13 No. B) was used to measure the ordinary temperature elongation in the rolling direction. Further, the high temperature strength (yield strength) at 950° C. was measured. In heat resistant steel, if the ordinary temperature elongation is 35% or more and the high temperature strength is 20 MPa or more, severe press working and durability requirements are satisfied.

As clear from Table 2 and Table 4, when producing steel having the composition prescribed in the present invention by this method, compared with the comparative examples, it is learned that the average r value and the ordinary temperature elongation are high, the Δr becomes low, and the workability is superior. Further, the high temperature strength also satisfies the above range. Here, the amount and size of the Nb-based precipitates and the recrystallized grain size and recrystallization rate of the cold rolling materials were adjusted by changing the annealing conditions of the hot rolled sheet in accordance with the steel compositions. Depending on the steel composition, even without annealing the hot rolled sheet, sometimes the steel falls within the scope of the present invention. Further, if adding Cu, W, and Sn, the high temperature strength becomes higher which leads to a longer fatigue life of a heat resistant part.

Note that the thickness of the slab, the thickness of the hot rolled sheet, etc. should be suitably designed. The annealing conditions of the hot rolled sheet should be suitably selected so that the precipitates and structure before annealing fall in the scope of the invention. Depending on the composition, annealing of the hot rolled sheet may be omitted. Further, in the cold rolling, the reduction rate, roll roughness, roll diameter, rolling oil, number of rolling passes, rolling speed, rolling temperature, etc. may be suitably selected. If employing a two-step cold rolling method with intermediately annealing in the middle of the cold rolling, the characteristics are further improved. The intermediate annealing and the final annealing may, if necessary, be bright annealing performed in hydrogen gas or nitrogen gas or other nonoxidizing atmosphere or annealing performed in the air.

TABLE 1

| | | Composition (wt %) | | | | | | | | | | | | | | Total precipitate |
|---|---|---|---|---|---|---|---|---|---|---|---|---|---|---|---|---|
| | No. | C | Si | Mn | P | Cr | N | Nb | Mo | Ti | Al | B | Cu | W | Sn | (wt %) |
| Inv. | 1 | 0.002 | 0.29 | 0.21 | 0.021 | 14.5 | 0.009 | 0.53 | 1.5 | — | — | — | — | — | — | 0.39 |
| ex. | 2 | 0.003 | 0.04 | 0.10 | 0.028 | 16.1 | 0.011 | 0.47 | 1.7 | 0.15 | 0.005 | 0.0005 | — | — | — | 0.44 |
| | 3 | 0.004 | 0.11 | 0.09 | 0.018 | 15.2 | 0.009 | 0.45 | 1.6 | 0.14 | 0.005 | 0.0005 | — | — | — | 0.39 |
| | 4 | 0.002 | 0.25 | 0.25 | 0.030 | 14.5 | 0.015 | 0.30 | 0.6 | 0.10 | 0.008 | 0.0003 | — | — | — | 0.28 |
| | 5 | 0.006 | 0.29 | 0.15 | 0.030 | 14.2 | 0.017 | 0.40 | 0.5 | 0.05 | 0.007 | 0.0009 | — | — | — | 0.17 |
| | 6 | 0.003 | 0.25 | 0.15 | 0.035 | 18.8 | 0.013 | 0.55 | 1.8 | 0.13 | 0.030 | 0.0005 | — | — | — | 0.33 |
| | 7 | 0.003 | 0.05 | 0.09 | 0.015 | 19.2 | 0.009 | 0.55 | 1.8 | 0.11 | 0.006 | 0.0006 | — | — | — | 0.36 |
| | 8 | 0.008 | 0.13 | 0.25 | 0.021 | 11.3 | 0.018 | 0.41 | 0.5 | 0.06 | 0.070 | 0.0006 | — | — | — | 0.09 |
| | 9 | 0.005 | 0.16 | 0.05 | 0.013 | 11.2 | 0.008 | 0.32 | 0.6 | 0.09 | 0.031 | 0.0010 | — | — | — | 0.11 |
| | 10 | 0.007 | 0.28 | 0.13 | 0.010 | 15.8 | 0.011 | 0.45 | 0.7 | 0.14 | 0.010 | 0.0032 | 0.25 | — | — | 0.15 |
| | 11 | 0.004 | 0.25 | 0.15 | 0.010 | 16.3 | 0.008 | 0.55 | 1.1 | 0.05 | — | 0.0026 | — | 0.5 | — | 0.45 |
| | 12 | 0.005 | 0.16 | 0.14 | 0.010 | 17.8 | 0.013 | 0.55 | 1.6 | 0.03 | 0.070 | 0.0013 | — | — | 0.12 | 0.49 |
| | 13 | 0.006 | 0.15 | 0.11 | 0.020 | 18.6 | 0.005 | 0.77 | 1.8 | 0.18 | — | 0.0011 | 0.52 | — | 0.05 | 0.50 |
| | 14 | 0.009 | 0.06 | 0.09 | 0.010 | 18.3 | 0.003 | 0.55 | 1.4 | 0.15 | 0.006 | 0.0008 | 2.3 | — | — | 0.49 |
| | 15 | 0.006 | 0.18 | 0.15 | 0.040 | 17.1 | 0.004 | 0.53 | 1.2 | 0.02 | — | 0.0006 | 0.3 | 0.5 | 0.5 | 0.43 |
| | 16 | 0.003 | 0.12 | 0.25 | 0.020 | 16.2 | 0.001 | 0.55 | 1.1 | 0.17 | 0.006 | 0.0004 | 0.65 | 0.13 | — | 0.41 |

TABLE 2

| | | Cold rolled sheet annealing | Hot rolled sheet annealing conditions | | Am't of Nb-based precipitates of cold rolling | Diameter of Nb-based precipitates of cold rolling | Recrystallized grain size of cold rolling | Recrystallization rate of cold | r value of | Δr value of | Elongation of sheet | High temperature strength of sheet |
|---|---|---|---|---|---|---|---|---|---|---|---|---|
| | No. | temp. (° C.) | Temp. (° C.) | Time (sec) | material (vol %) | material (μm) | material (μm) | rolling material (%) | sheet product | sheet product | product (%) | product (MPa) |
| Inv. | 1 | 1050 | 950 | 60 | 0.32 | 0.20 | 16 | 16 | 1.5 | 0.1 | 35 | 21 |
| ex. | 2 | 1075 | 930 | 60 | 0.19 | 0.16 | 38 | 85 | 1.6 | 0.3 | 36 | 22 |
| | 3 | 1050 | 900 | 50 | 0.23 | 0.15 | 32 | 89 | 1.6 | 0.3 | 37 | 21 |
| | 4 | 1050 | 850 | 130 | 0.29 | 0.25 | 36 | 85 | 1.7 | 0.2 | 38 | 20 |
| | 5 | 1030 | None | None | 0.38 | 0.16 | 23 | 30 | 1.6 | 0.2 | 38 | 22 |
| | 6 | 1075 | 940 | 70 | 0.54 | 0.34 | 38 | 75 | 1.4 | 0.3 | 35 | 24 |
| | 7 | 1075 | 850 | 3600 | 0.51 | 0.22 | 31 | 46 | 1.5 | 0.2 | 35 | 25 |
| | 8 | 1010 | 830 | 36000 | 0.38 | 0.12 | 40 | 79 | 1.6 | 0.2 | 39 | 25 |
| | 9 | 1010 | None | None | 0.23 | 0.11 | 16 | 53 | 1.5 | 0.1 | 40 | 22 |
| | 10 | 1030 | 800 | 9000 | 0.41 | 0.60 | 32 | 31 | 1.4 | 0.2 | 36 | 24 |
| | 11 | 1070 | 900 | 120 | 0.46 | 0.25 | 28 | 56 | 1.6 | 0.2 | 38 | 25 |
| | 12 | 1070 | 950 | 60 | 0.55 | 0.19 | 25 | 76 | 1.5 | 0.3 | 35 | 26 |
| | 13 | 1070 | 750 | 36000 | 0.59 | 0.43 | 19 | 74 | 1.7 | 0.1 | 35 | 26 |
| | 14 | 1070 | 950 | 60 | 0.43 | 0.34 | 37 | 85 | 1.5 | 0.4 | 35 | 27 |
| | 15 | 1070 | 810 | 30 | 0.51 | 0.53 | 32 | 64 | 1.6 | 0.3 | 38 | 26 |
| | 16 | 1070 | 750 | 3600 | 0.58 | 0.54 | 33 | 54 | 1.5 | 0.3 | 37 | 29 |

TABLE 3

| | No. | Composition (wt %) C | Si | Mn | P | Cr | N | Nb | Mo | Ti | Al | B | Cu | W | Sn | Total precipitates (wt %) |
|---|---|---|---|---|---|---|---|---|---|---|---|---|---|---|---|---|
| Comp. ex. | 17 | 0.015* | 0.04 | 0.10 | 0.028 | 16.1 | 0.011 | 0.47 | 1.7 | 0.15 | 0.005 | 0.0005 | — | — | — | 0.49 |
| | 18 | 0.006 | 1.2* | 0.25 | 0.030 | 14.2 | 0.017 | 0.40 | 0.5 | 0.05 | 0.007 | 0.0009 | — | — | — | 0.41 |
| | 19 | 0.007 | 0.24 | 1.2* | 0.015 | 19.2 | 0.009 | 0.55 | 1.8 | 0.11 | 0.006 | 0.0006 | — | — | — | 0.35 |
| | 20 | 0.003 | 0.15 | 0.07 | 0.045* | 15.8 | 0.011 | 0.45 | 0.7 | 0.05 | 0.010 | 0.0032 | — | — | — | 0.34 |
| | 21 | 0.004 | 0.11 | 0.06 | 0.01 | 22.5* | 0.015 | 0.30 | 0.6 | 0.10 | 0.008 | 0.0003 | — | — | — | 0.58 |
| | 22 | 0.003 | 0.08 | 0.07 | 0.028 | 14.5 | 0.026* | 0.40 | 0.5 | 0.05 | 0.007 | 0.0009 | — | — | — | 0.15 |
| | 23 | 0.006 | 0.25 | 0.29 | 0.03 | 16.1 | 0.009 | 1.1* | 0.5 | — | — | — | — | — | — | 0.65* |
| | 24 | 0.003 | 0.29 | 0.25 | 0.02 | 14.0 | 0.009 | 0.23* | 0.5 | 0.05 | 0.070 | 0.0006 | — | — | — | 0.16 |
| | 25 | 0.006 | 0.09 | 0.22 | 0.01 | 14.9 | 0.013 | 0.31 | 0.2* | — | — | — | — | — | — | 0.11 |
| | 26 | 0.005 | 0.05 | 0.24 | 0.03 | 14.1 | 0.001 | 0.65 | 2.1* | 0.15 | 0.007 | 0.0009 | — | — | — | 0.78* |
| | 27 | 0.006 | 0.23 | 0.14 | 0.01 | 16.1 | 0.004 | 0.63 | 1.5 | 0.25* | 0.007 | 0.0009 | — | — | — | 0.42 |
| | 28 | 0.008 | 0.28 | 0.16 | 0.04 | 14.1 | 0.003 | 0.90 | 0.5 | 0.15 | 0.16* | 0.0010 | — | — | — | 0.46 |
| | 29 | 0.007 | 0.05 | 0.05 | 0.02 | 16.8 | 0.006 | 0.77 | 0.6 | 0.05 | 0.063 | 0.0055* | — | — | — | 0.58 |
| | 30 | 0.007 | 0.18 | 0.23 | 0.01 | 15.8 | 0.011 | 0.45 | 0.7 | 0.11 | 0.010 | 0.0032 | 3.6* | — | — | 0.78* |
| | 31 | 0.004 | 0.05 | 0.05 | 0.01 | 16.3 | 0.008 | 0.55 | 1.1 | 0.18 | 0.054 | 0.0026 | — | 1.2* | — | 0.59 |
| | 32 | 0.005 | 0.05 | 0.14 | 0.01 | 17.8 | 0.013 | 0.55 | 1.6 | 0.03 | 0.07 | 0.0013 | — | — | 1.8* | 0.52 |
| | 33 | 0.002 | 0.29 | 0.13 | 0.02 | 14.2 | 0.012 | 0.51 | 1.8 | — | — | — | — | — | — | 0.61* |
| | 34 | 0.003 | 0.28 | 0.10 | 0.02 | 16.3 | 0.015 | 0.48 | 1.9 | 0.18 | 0.008 | 0.0009 | — | — | — | 0.75* |
| | 35 | 0.003 | 0.04 | 0.10 | 0.028 | 16.1 | 0.011 | 0.47 | 1.7 | 0.15 | 0.005 | 0.0005 | — | — | — | 0.61* |
| | 36 | 0.004 | 0.13 | 0.11 | 0.018 | 16.9 | 0.013 | 0.42 | 1.3 | — | — | — | — | — | — | 0.64* |
| | 37 | 0.002 | 0.11 | 0.09 | 0.03 | 16.2 | 0.015 | 0.55 | 1.6 | 0.11 | 0.006 | 0.0008 | — | — | — | 0.79* |
| | 38 | 0.004 | 0.23 | 0.09 | 0.018 | 15.2 | 0.009 | 0.39 | 1.5 | 0.11 | 0.005 | 0.0005 | — | — | — | 0.82* |
| | 39 | 0.003 | 0.05 | 0.09 | 0.015 | 19.2 | 0.009 | 0.55 | 1.8 | 0.11 | 0.006 | 0.0006 | — | — | — | 0.83* |
| | 40 | 0.007 | 0.28 | 0.13 | 0.010 | 15.8 | 0.011 | 0.45 | 0.7 | 0.14 | 0.010 | 0.0032 | 0.25 | — | — | 0.62* |
| | 41 | 0.004 | 0.25 | 0.25 | 0.010 | 16.3 | 0.008 | 0.55 | 1.1 | 0.05 | — | 0.0026 | — | 0.5 | — | 0.73* |
| | 42 | 0.005 | 0.26 | 0.21 | 0.010 | 17.8 | 0.013 | 0.55 | 1.6 | 0.03 | 0.070 | 0.0013 | — | — | 0.12 | 0.72* |
| | 43 | 0.006 | 0.15 | 0.11 | 0.020 | 18.6 | 0.005 | 0.55 | 1.8 | 0.18 | — | 0.0011 | 0.52 | — | 0.05 | 0.65* |
| | 44 | 0.009 | 0.06 | 0.09 | 0.010 | 18.3 | 0.003 | 0.55 | 1.4 | 0.15 | 0.006 | 0.0008 | 2.3 | — | — | 1.23* |

*Outside scope of present invention

TABLE 4

| | No. | Cold rolled sheet annealing temp. (° C.) | Hot rolled sheet annealing conditions Temp. (° C.) | Time (sec) | Am't of Nb-based precipitates of cold rolling material (vol %) | Diameter of Nb-based precipitates of cold rolling material (μm) | Recrystallized grain size of cold rolling material (μm) | Recrystallization rate of cold rolling material (%) | r value of sheet product | Δr value of sheet product | Elongation of sheet product (%) | High temperature strength of sheet product (MPa) |
|---|---|---|---|---|---|---|---|---|---|---|---|---|
| Comp. ex. | 17 | 1070 | 850 | 60 | 0.18 | 0.13 | 64* | 100* | 0.9* | 0.6* | 30* | 16* |
| | 18 | 1030 | 950 | 100 | 0.23 | 0.15 | 78* | 100* | 1.1* | 0.6* | 29* | 23 |
| | 19 | 1070 | 920 | 30 | 0.26 | 0.26 | 65* | 95* | 1.4 | 0.4 | 32* | 24 |
| | 20 | 1030 | 925 | 160 | 0.34 | 0.19 | 55* | 100* | 1.4 | 0.4 | 34* | 24 |
| | 21 | 1070 | 975 | 40 | 0.28 | 0.31 | 53* | 83* | 1.4 | 0.4 | 30* | 25 |
| | 22 | 1050 | 950 | 60 | 0.24 | 0.26 | 73* | 100* | 1.3* | 0.7* | 30* | 21* |
| | 23 | 1050 | 1150 | 80 | 0.12* | 0.09* | 85* | 95 | 0.9* | 0.9* | 28* | 26 |
| | 24 | 1030 | 1000 | 50 | 0.39 | 0.18 | 66* | 96* | 1.1* | 0.6* | 31* | 17* |
| | 25 | 1030 | 850 | 60 | 0.15 | 0.07* | 38 | 100* | 0.9* | 0.8* | 38 | 17* |
| | 26 | 1030 | 850 | 1000 | 0.59 | 0.09* | 22 | 20 | 0.9* | 0.4 | 29* | 23 |
| | 27 | 1030 | 950 | 60 | 0.55 | 0.62 | 40 | 77 | 1.6 | 0.4 | 33* | 19* |
| | 28 | 1030 | 850 | 36000 | 0.58 | 0.26 | 83* | 40 | 1.3* | 0.4 | 33* | 20 |
| | 29 | 1070 | 950 | 25 | 0.43 | 0.17 | 33 | 50 | 1.3* | 0.4 | 31* | 20 |
| | 30 | 1050 | 1100 | 100 | 0.39 | 0.23 | 67* | 85 | 1.3* | 0.4 | 25* | 25 |
| | 31 | 1070 | 1100 | 100 | 0.20 | 0.22 | 84* | 95* | 1.3* | 0.6* | 25* | 26 |
| | 32 | 1070 | 1100 | 100 | 0.30 | 0.33 | 103* | 100* | 1.2* | 0.9* | 25* | 27 |
| | 33 | 900* | 950 | 80 | 0.31 | 0.21 | 18 | 21 | 1.5 | 0.1 | 32* | 21 |
| | 34 | 900* | 940 | 70 | 0.16 | 0.18 | 39 | 88 | 1.6 | 0.3 | 34* | 22 |
| | 35 | 950* | 1000 | 60 | 0.05* | 0.09* | 55* | 95* | 1.3* | 0.6* | 34* | 22 |
| | 36 | 980* | 700 | 30000 | 0.40 | 0.09* | 40 | 2* | 1.3* | 0.9* | 34* | 21 |
| | 37 | 1000* | 1020 | 150 | 0.13 | 0.12 | 120* | 100* | 0.9* | 0.8* | 33* | 22 |
| | 38 | 950* | 1000 | 100 | 0.15 | 0.11 | 64* | 90 | 1.3* | 0.5* | 34* | 21 |
| | 39 | 900* | 1010 | 30 | 0.51 | 0.22 | 40 | 100* | 1.4 | 0.5* | 32* | 25 |
| | 40 | 1000* | None | None | 0.19 | 0.15 | 60* | 2* | 1.1* | 0.1 | 36 | 24 |
| | 41 | 1000* | 1050 | 120 | 0.05* | 0.11 | 89 | 86* | 1.3* | 0.6* | 35 | 25 |
| | 42 | 1000* | 700 | 300 | 0.35 | 0.08* | 38 | 20 | 1.2* | 0.3 | 33* | 26 |
| | 43 | 1000* | 1100 | 500 | 0.23 | 0.53 | 83* | 85 | 1.3* | 0.5* | 33* | 26 |
| | 44 | 950* | 1075 | 60 | 0.23 | 0.24 | 38 | 100* | 1.3* | 0.5* | 27* | 27 |

*Outside scope of present invention

INDUSTRIAL APPLICABILITY

According to the present invention, it is possible to efficiently produce ferritic stainless steel sheet superior in shapeabiliity with requiring any new facilities.

The invention claimed is:

1. A method of production of a ferritic stainless steel sheet superior in shapeability with an elongation ratio of 35% or more, r value of 1.4 or more, and Δr value of 0.4 or less, characterized by (i) producing a cold rolling material having a composition comprising, by wt %:

C: 0.001 to 0.010%,
Si: 0.01 to 0.3%,
Mn: 0.01 to 0.3%,
P: 0.01 to 0.04%,
N: 0.001 to 0.020%,
Cr: 10 to 20%,
Nb: 0.3 to 1.0%, and
Mo: 0.5 to 2.0%
Having a balance of Fe and unavoidable impurities;

(ii) heat treating the cold rolling material at a temperature range of 900 to 950° C. for 50 to 120 seconds so that Nb-based precipitates become, by vol %, 0.15% to 0.6% and having a diameter of 0.1 μm to 1 μm;

(iii) then cold rolling; and (iv) annealing it at 1010 to 1080° C.

2. A method of production of a ferritic stainless steel sheet superior in shapeability with an elongation ratio of 35% or more, r value of 1.4 or more, and Δr value of 0.4 or less, characterized by (i) producing a cold rolling material having a composition comprising, by wt %:

C: 0.001 to 0.010%,
Si: 0.01 to 0.3%,
Mn: 0.01 to 0.3%,
P: 0.01 to 0.04%,
N: 0.001 to 0.020%,
Cr: 10 to 20%,
Nb: 0.3 to 1.0%, and
Mo: 0.5 to 2.0%
Having a balance of Fe and unavoidable impurities;

(ii) heat treating the cold rolling material at a temperature range of 900 to 950° C. for 50 to 120 seconds so that a recrystallized grain size becomes 1 μm to 40 μm and a recrystallization rate becomes 10 to 90%;

(iii) then cold rolling; and (iv) annealing it at 1010 to 1080° C.

3. A method of production of a ferritic stainless steel sheet superior in shapeability with an elongation ratio of 35% or more, r value of 1.4 or more, and Δr value of 0.4 or less, characterized by (i) producing a cold rolling material having a composition comprising, by wt %:

C: 0.001 to 0.010%,
Si: 0.01 to 0.3%,
Mn: 0.01 to 0.3%,
P: 0.01 to 0.04%,
N: 0.001 to 0.020%,
Cr: 10 to 20%,
Nb: 0.3 to 1.0%, and
Mo: 0.5 to 2.0%
Having a balance of Fe and unavoidable impurities;

(ii) heat treating the cold rolling material at a temperature range of 900 to 950° C. for 50 to 120 seconds so that Nb-based precipitates become, by vol %, 0.15% to 0.6% and having a diameter of 0.1 μm to 1 μm; a recrystallized grain size becomes 1 μm to 40 μm; and a recrystallization rate becomes 10 to 90%;

(iii) then cold rolling; and (iv) annealing it at 1010 to 1080° C.

* * * * *